US011143484B2

(12) United States Patent
Deveau

(10) Patent No.: US 11,143,484 B2
(45) Date of Patent: Oct. 12, 2021

(54) RUNNER'S SELF-DEFENSE SYSTEM

(71) Applicant: Janice S. Deveau, Burlington, CT (US)

(72) Inventor: Janice S. Deveau, Burlington, CT (US)

(73) Assignee: Janice S. Deveau, Candler, FL (US)

( * ) Notice: Subject to any disclaimer, the term of this patent is extended or adjusted under 35 U.S.C. 154(b) by 0 days.

(21) Appl. No.: 15/883,900

(22) Filed: Jan. 30, 2018

(65) Prior Publication Data

US 2019/0234706 A1 Aug. 1, 2019

(51) Int. Cl.
*F41B 15/08* (2006.01)
*A41D 19/015* (2006.01)
(Continued)

(52) U.S. Cl.
CPC ..... *F41B 15/08* (2013.01); *A41D 19/002* (2013.01); *A41D 19/01* (2013.01); *A41D 19/01594* (2013.01)

(58) Field of Classification Search
CPC . F41B 15/08; A41D 19/002; A41D 19/01594; A41D 19/01
See application file for complete search history.

(56) References Cited

U.S. PATENT DOCUMENTS 5,898,938 A * 5/1999 Baylor ..... A41D 19/01523 2/20
2008/0244799 A1* 10/2008 Winningham ... A41D 19/01523 2/16

(Continued)

OTHER PUBLICATIONS

Weapons Universe, "SAP Gloves," May 21, 2014, https://web.archive.org/web/20140521221539/http://www.weapons-universe.com/sap-gloves.htm (Year: 2014).*

(Continued)

*Primary Examiner* — Kevin Y Kim
(74) *Attorney, Agent, or Firm* — BJ Associates; Bolesh J Skutnik

(57) ABSTRACT

A sports glove(s) for self-defense against human and animal predator(s) that includes a striker plate that is fixed to and becomes a component, part of the self-defense system, especially useful for runners to defend against human or animal predator(s), particularly useful for females and others of slight build and strength, while engaged in the sport of running. Using the Runner's Self Defense System does not interfere with runner's personal sport objectives, nor does it impose a safety threat to the runner but becomes part of standard and normal running apparel. The glove can be finger-tip less (opened fingered) or a complete glove. The glove palm includes a separate interior palm liner to anchor an appendage of the striker plate. The glove back side is furnished to allow efficient air circulation to keep hands cool. The striker plate inside the glove is lightweight yet dense, having finger holes, aligned for finger passage through the striker plate and glove simultaneously, while the palm support appendage provides rigid protection of the fingers when the hand is fully closed in a fist position. It is the interaction of, glove fixed to striker plate then fitted to fingers, that do secure the system in place while defending oneself, or not, without interruption, distraction, discomfort, or thought, the glove to the hand, acting as one, while engaged in the sport of running.

17 Claims, 6 Drawing Sheets

(51) Int. Cl.
*A41D 19/01* (2006.01)
*A41D 19/00* (2006.01)

(56) References Cited

U.S. PATENT DOCUMENTS

| | | | | |
|---|---|---|---|---|
| 2012/0117704 | A1* | 5/2012 | Hofeldt | A41D 19/01523 2/20 |
| 2013/0019366 | A1* | 1/2013 | Mechling | A41D 13/06 2/18 |
| 2013/0165239 | A1* | 6/2013 | Gaudet | F41B 15/08 463/47.2 |

OTHER PUBLICATIONS

Weapons Universe, "SAP Gloves, Fingerless, Medium," Jun. 3, 2014, https://web.archive.org/web/20140603135003/http://www.weapons-universe.com/Personal_Defense/Gloves/SAP_Gloves-Fingerless-Medium.shtml (Year: 2014).*

* cited by examiner

LEFT HAND GLOVE
BACK SIDE VIEW

RIGHT HAND GLOVE
BACK SIDE VIEW

SECTIONAL VIEW A-A
PALM SIDE DOWN

SECTIONAL VIEW B-B
PALM SIDE UP

RUNNER'S SELF-DEFENSE SYSTEM

BACKGROUND OF THE INVENTION

1. Field of the Invention

The present invention is in the general fields of sporting goods and self-defense. In particular, in the defense of solitary distance runners, joggers, walkers and persons in similar endeavors.

2. Prior Art Statement

Running, including jogging and walking, is a popular solitary sport that involves individuals running on streets and off-road trails, covering far distances for long periods of time in potentially unsafe surroundings. In particular, female runners and others being of slight build have been targeted and subject to assault by predators, due to the fact that female runners and others known to have limited aptitude and physical strength and are not easily able to successfully defend themselves against stronger predators, human or animal.

Several attempts have been made to provide an effective self-defense glove, by combining combative components with gloves, to be used for self-defense, but none of these designs benefit runners while engaged in the sport of running and notably, some components present a safety concern for the user and should not be used while running. All reasonable attempts are missing some important benefits which are provided by the present invention.

A patent by Kerns, U.S. Pat. No. 5,095,547 describes a self-defense glove as having flexible abrasive metallic strips attached to the exterior surface of the glove, along the intended striking contact area, namely, the backside of the fingers. Unfortunately, the result of a direct self-defense strike could be ineffective due to the intent which is only to inflict skin abrasions to exposed skin. A direct strike to a clothed skin surface may not inflict any physical trauma at all, not adequate to ward off an attack. During an attack, the glove could be grabbed and twisted, rotating the metallic strips whereas they are no longer located on the backside of the fingers. The metallic strips could be rendered useless if not in the correct position. There is no abrasive metallic strip attached to the side of the hand along the small finger region, therefore, a basic a hammer strike could be ineffective. The glove offers no protection, no support or alignment of the fingers, and does not secure the position of the fingers, therefore, a self-defense strike made against an attacker could result in injury to the wearer's fingers and finger joints. Although flexible, the abrasive metallic strips may not allow for a natural loose closed fist hand posture recommended for efficient running. There is no mention of the need for cooling the hand during running, wearing the glove could be too hot and very uncomfortable to use while running due to each finger being completely covered first by the glove material and secondly by the attached metallic strips. There is no mention that fully covered fingers could make it difficult for the runner to adjust shoe laces, clothing zippers, buttons or similar while running. The runner would need to first remove the gloves and in doing so, disarming oneself, just to make simple, routine clothing adjustments. If worn during an attack, the fully covered fingers would hinder grappling capabilities. Because there is no integration between the glove and the hand, if grabbed by the fingers, the glove could be pulled off the hand, by an attacker, completely disarming the runner. The possibility of disarming the wearer is, also increased by forfeiting the element of surprise due to the unconcealed high profile abrasive metallic strips. The self-defense benefits are limited and ineffective and the gloves do not support the needs of a runner.

A patent by Quinn, U.S. Pat. No. 5,318,492 describes a jogging weight with repellent chemical. Unfortunately, concerning the use of a jogging weight, the sport of running does not include or promote using hand weights while running which could lead to serious injuries to the back, shoulder, elbow, and knee joints. A runner in motion produces synchronized arm and leg movements generating a high number of repetitions per minute. By itself, weight lifting is meant to exercise the muscles by full contraction and extension, each repetition being a slow and precise movement. A runner could not safely combine the use of a hand weight jogging devices because it interferes with a fast foot pace and arm motion, the basic form desired by all runners.

Attempting to run with hand jogging weights could result in extreme and unnecessary fatigue of the upper body and extremities. The hands would suffer the most, being forced to continuously grip and carry the weights for the entire run, in conflict with the recommended natural, loose fist and relaxed position to minimize unnecessary fatigue.

Runners and joggers can often be seen carrying bottled water while running to maintain adequate hydration levels. It is not reasonable to carry water with your hand while gripping jogging weights.

The use of a chemical spray does not provide a state of readiness due to the need to trigger the spray and the spray needing to be aimed correctly and having the need to make contact with the target face with sufficient volume discharged to be effective. There is no method to, inspect the chemical spray cartridge, to make certain positively that there is always adequate volume of chemical and propellant. Taking proper aim at an attacker involves time and skill and if attempted under stressful conditions and while holding up a weighted object with already fatigued muscles could have little chance of successfully warding off an attack.

Attempting to strike an attacker with a weighted object in hand would be too slow and sluggish to be effective, and could also result in severe hyperextension of the elbow and or shoulder joint. Using hand held jogging weights forfeit the element of surprise since hand held jogging weight and chemical spray canister are highly visible. The jogging weight is not fitted to the hand, but instead, is held by the wearer. The hand is first inserted through a generally large open handle like configuration and then grasped and held tightly by the fingers. There is no integration between the weight and the hand. The jogging weight could easily be dropped, or pulled off the hand, disarming the wearer.

While running, there is often a need for simple routine adjustment of clothing/running gear such as jackets, zippers, buttons, shoe laces, hats, and similar needs. A runner should be able to attend to routine adjustments without the need to stop. Due to the awkwardness of the jogging weights, the wearer would need to stop running and purposely disarm him/herself each and every time an adjustment was needed, greatly interfering with the sport of running.

Using jogging weights while running serves no practical purpose in terms of developing muscle fitness nor does it support the sport of running or use of self-defense and may cause injury to the runner.

A patent by Seats, U.S. Pat. No. 5,943,701 describes a combined hand glove and aerosol repellent device which is held in place, parallel with, and in alignment with the inside of the first finger digit. Unfortunately, since the fingertip extends well beyond the aerosol trigger, the finger must be held in a stiff and fully extended position at all times, not allowing the hand to maintain a loose closed fist position for relaxed and efficient running. With the finger fully extended, the finger and hand would soon be fatigued and could not be held in the ready position for any significant length of time due to personal discomfort. There wearer may choose to disarm from the ready position periodically to reduce discomfort. Taking aim against an attacker could be difficult due to the awkward positioning of the index finger for extended periods of time while running long distances.

The use of a chemical spray does not provide a state of readiness due to the need to trigger the spray and the spray needing to be aimed correctly and make contact with the target face with sufficient volume discharged to be effective. There is no method to inspect the chemical spray cartridge, to make certain positively that there was adequate volume of chemical and propellant. There is no mention of any others means of self-defense other than the aerosol repellent. It would be easy to disarm the wearer of the aerosol repellent spray canister that is only held in place by a short loop in the glove and Velcro or similar. The lone finger digit that triggers the chemical spray has no protection during an attack and is more vulnerable and likely more subject to serious joint injury while being disarmed.

While running, when there is often a need for simple routine adjustment of clothing/running gear, due to the awkwardness of the single finger digit forced to hold in the ready position, the wearer may simply choose to stop running and purposely disarm him/herself each time as needed.

Besides the use of a chemical spray, there are no other self-defense benefits mentioned.

A patent by McDonald, U.S. Pat. No. 9,091,504 describes a defensive or offensive weapon in the form of a large mitten having a plurality of outwardly directed spikes having pointed ends. Unfortunately, a runner or jogger cannot safely use this device because of the exposed spikes. Running results in regular and highly repetitive arm and leg motion. The exposed spikes would pass dangerously close to the runner's own body during each arm movement that is synchronized with each stride. Protruding spikes could easily catch and tear into the runner's own clothing and skin, and could cause an injury. In the event of a fall, if the runner fell on top of this glove, multiple exposed spikes could puncture into the body, and could result in a severe injury.

To wear this combative mitten, the runner would need to grasp a thin rod fixed inside the mitten. Gripping the rod that keeps the mitten place does not allow for the loose closed fist position.

McDonald did not suggest that this devise be worn openly for any reason and further suggested that this device be kept stored and hidden at an appropriate and strategic location anywhere where desired, where imminent danger may be present. This devise is not compatible with the sport of running or jogging. It could be considered a dangerous weapon with limited applications.

A patent by Hoppes, U.S. Pat. No. 8,413,265 describes a glove with retractable ice pick located in a position (in the palm area of the glove) to be grasped by a user for ice fishing. Unfortunately, if used while running, the ice pick needs to be in a safety lock mode until triggered when needed for self-defense, having no state of readiness. The location of the secured ice pick severely limits a successful hand strike due to the need for the pick to strike as close as possible to perpendicular to the body target in order for the pick to penetrate clothes and skin, otherwise an ineffective glancing strike without penetration could result.

A runner could not safely use this device unlocked with the ice pick extended because it could easily interfere with the continuous leg and arm motion of the runner. The ice pick could strike the runner's own body during these normal running movements. There is no mention of using the ice pick for any activity besides ice fishing and there is no mention of the device being used for self-defense for runners. This could be viewed as a very obvious and dangerous weapon, not compatible with the sport of running or acceptable to use for self-defense.

What is still needed is a supportive and integrated runner's self-defense system, a pair of running gloves that are safe to use, simple, secure, and easy to wear even during long runs, gloves that support and not diminish the sport of running, that are always ready to use for self-defense, always providing an absolute intuitive and uninterrupted state of readiness.

SUMMARY AND OBJECTIVES OF THE INVENTION

It is an object of the present invention, a runner's self-defense system, running sports gloves, that provide the freedom and empowerment of having a state of uninterrupted, unthinking readiness without distraction, is easy and safe to wear and use, used primarily by female runners or others being of slight build, enabling the wearer to effectively defend oneself by aggressively striking back against a physical attack by human or animal predator, to ward off an attack and survive a physical confrontation.

It is another object of the present invention, self-defense running sports gloves, is to diminish the concern of ever being disarmed. The fitted gloves can't be pulled off, slipped off, dropped, or otherwise made useless during a physical encounter. There is never a need to remove the gloves, to self-disarm, due to the form, fit, function and integration of glove to hand. The gloves become a standard element of running gear/equipment to the runner, worn while engaged in the sport of running.

It is another objective of the present invention, self-defense running/sports gloves to effortlessly maintain the recommended hand position for both running and self-defense, which is to have the hand relaxed and fingers slightly curled in a loose fist position. The striker plate is fitted to the fingers and fixed in the glove. The hands are kept relaxed in a ready position, with fingers loosely wrapped around and loosely clutching the striker plate maintaining the loose fist position, the ideal and precise hand position for both running and self-defense.

It is another object of the present invention, self-defense running/sports gloves to be inconspicuous and low profile, allowing the runner to utilize the element of surprise when needing to defend oneself against a predator. The striker plate used as a combative component is hidden internally within the glove, completely concealed. The glove style and color scheme(s) and overall appearance do not draw attention to the gloves.

It is another object of the present invention to allow a runner to run in a safe and protected manner, without concern of being subject to any personal injury caused by the running gloves themselves, never being dangerous to wear, regardless of running pace or style. Besides being safe to wear, the gloves add an additional safety element while worn in the event of a fall. During a fall, the gloves would offer general yet dependable protection of the hands due to the glove materials and internal fixed striker plate. Wearing the running gloves does not ever add fatigue, create distraction or discomfort and are always dependable to maintain the ever-ready hand position for self-defense.

It is another object of the present invention, that the self-defense running sports gloves be comfortable and supportive to the runner. The gloves keeping the hands cool while running by using vented material on backhand side of the glove and a moisture wicking inner layer on the palm side. The internal striker plate is also vented. The material positioned on the backhand side of the glove also serves the purpose to conveniently and effectively wipe perspiration off the brow regularly and frequently while running, without any interruption or distraction to the runner. The gloves make up a significant component of regular running gear beyond self-defense.

It is another object of the present invention, self-defense running sports glove is to retain full finger digit range of motion and finger manipulation by having the glove be fingertip less, to support the runner's needs to regularly adjust hats, clothing, buttons and zippers, tie shoes, carry water, all while retaining finger grappling ability, an important additional support for self-defense actions.

It is another object of the present invention, self-defense running sports glove to provide a convenient palm size carry pouch between layers of the palm materials. This carry pouch is of adequate size to store small personal items at runner's discretion and is secured with a side tab. Items easy to carry could be keys, identification, flat whistles, or other items of similar size.

Briefly stated, in the present invention is a runner's self-defense system, a runner's sport gloves that includes a single backside layer and two palm side layers, a striker plate, the combative component, fitted to fingers, and fixed to the inside of the glove, used by runners or joggers, particularly females and others of slight build, while engaged in the sport of running. The glove is finger-tip less. The glove palm interior liner interlocks and anchors the striker plate appendage between the two palm side layers. The glove backside is furnished with materials to keep the hands cool. The internal striker plate is lightweight yet dense, having finger hole(s) aligned for easy finger passage through the plate and glove simultaneously, while the plate appendage provides finger protection and the ever-ready hand position for both running and self-defense. The system is the integration of the glove to striker plate to fingers, securing the system in place, acting as normal running gear without adding interruption, distraction, or interference with the runner's personal sport objectives, and does not ever impose a safety threat to the runner and becomes a standard element of regular running gear equipment to the runner, worn while engaged in the sport of running.

The above, and other objects, features, advantages, variations, and modifications of the present invention will become apparent from the following description read in conjunction with the accompanying drawings.

DETAILED DESCRIPTION OF PREFERRED EMBODIMENTS

Figure 1:
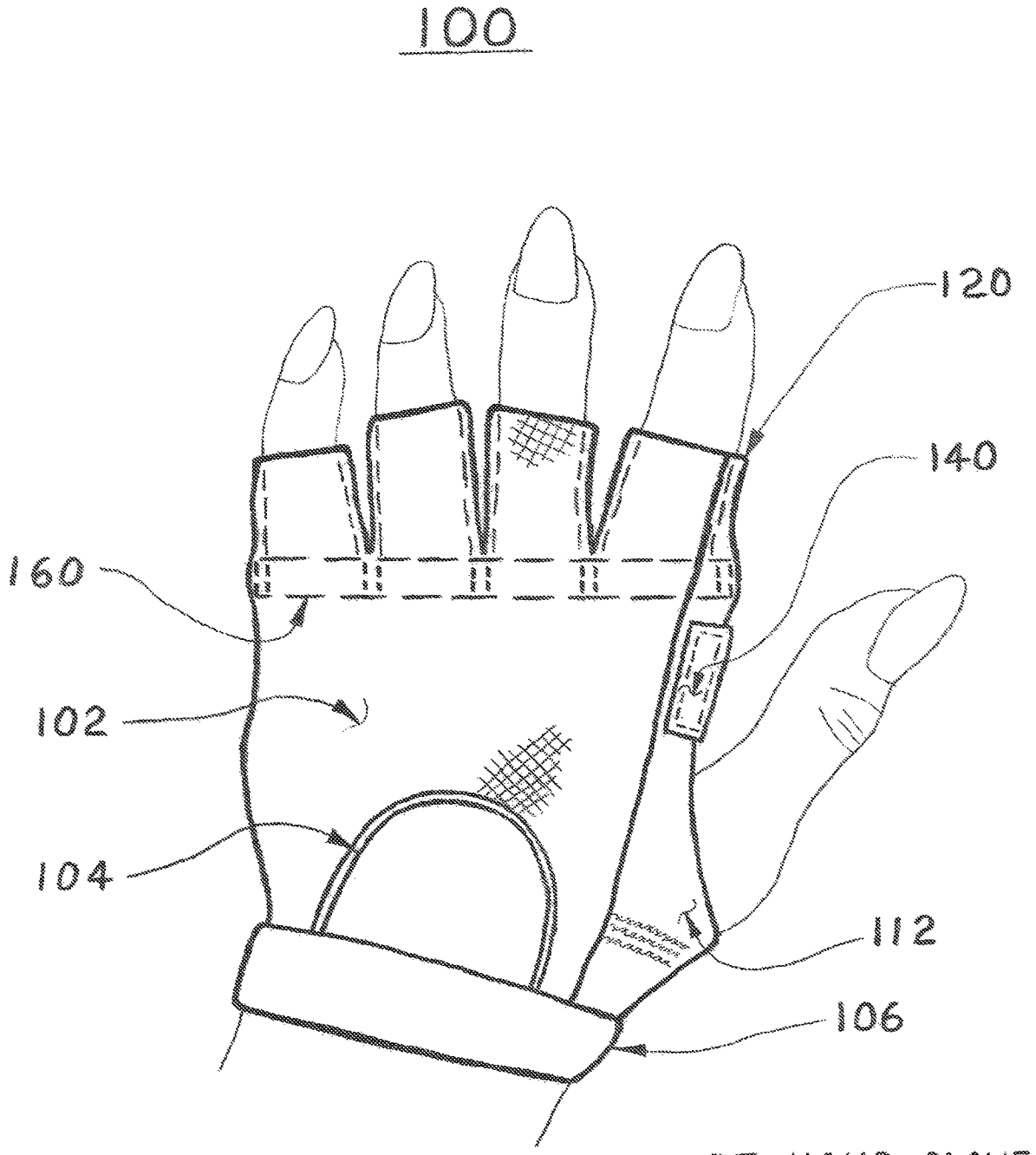
FIGS. 1 and 2 show a view of a preferred embodiment of the left- and right-hand glove, back of hand side view, of the present invention of the Runner's Self Defense System running gloves, as worn.

Generally what is described is a glove or pair of hand gloves that incorporate a concealed striker plate, the combative component, having a palm support appendage and finger digit through holes, how the appendage is fixed to the inside of the glove, how the fingers are fitted through the striker plate holes, and when worn, how this system provides the ideal interaction of the glove, striker plate, hand and fingers, all individual components, and how they are linked together as one, and transformed into an ever ready and instinctive system of human self-defense, self-protection, and self-survival used primarily by females and those of slight build runners, joggers, and walkers.

The use and benefits of the runner's self-defense system is exemplified by the following A runner's self-defense system used primarily by females or those of slight build. Generally, a pair of fitted hand gloves that feature a hidden, combative component, a striker plate positioned inside each glove, resulting in a self-defense glove system one can use to, forcefully strike back and defend oneself against an attack. The wearer of the self-defense gloves has potential to inflict serious bodily injury as necessary to ward off and escape away from an aggressive human or animal predator. The wearer of the self-defense gloves is empowered, having a system of self-protection and tactic for survival.

A glove with striker plate, fitted to the hand and fingers, fingers inserted through the striker plate finger holes inside the glove, resulting in a complete fundamental system that keep the gloves intact on your hands while fingers in position, loosely clutching and in contact with the striker plate at all times, in a loose closed fist position, always in a self-defense readiness position, eliminating opportunity for the wearer to be disarmed by an assailant, either intentionally or accidentally during an attack.

The gloves themselves are lightweight and when worn, the position of the hands is always kept at rest, in a loose, closed fist position, a highly preferred position that is natural and most efficient for running and self-defense readiness, not ever adding fatigue, discomfort, or stress to the hand. Wearing the gloves does not ever impair or interfere with the runner's personal sport objectives.

The gloves are fingertip less, which allows opportunity for self-defensive grappling optimizing a natural element of self-defense. The gloves allow full range of motion and manipulation of the finger digits independently as needed for frequent and standard clothing adjustments that can be made while running. No need or reason to remove the self-defense gloves while running.

When worn, the striker plate maintains a physical connection between the palm and fingers, and generates slight compression of the glove palm material, resulting in an involuntary subtle and gentle pulling effect on the fingers, partially closing the hand, drawing the fingers into the optimal loosely closed, closed but not clenched, relaxed fist position, without any thought, effort, or energy, thus maintaining the state of uninterrupted and unthinking ever readiness while providing the most natural and efficient hand position ideal for both running and self-defense readiness.

The Runner's Self-Defense System may be best used by those having average or better than average athletic abilities and have had some prior training in basic self-defense techniques. However, even those individuals who do not possess strong athletic abilities or have not had any self-defense training can still utilize the system because the system itself is based on uninterrupted and unthinking readiness combined with instinctive movements of human self-defense, self-protection, and survival, by optimizing the most natural approach to self-defense which is defending by striking.

The Runner's Self Defense System preferably uses a right- and left-hand glove as a matching and balanced pair, which provides most efficient and effective opportunities for defending oneself during an attack, by means of aggressively striking back and inflicting physical trauma to a human or animal predator and warding off the attack. It is preferable to use both hands but if the individual has limited or no use of one hand, a single glove system would still be useful, offering all the same benefits of protection. Even those individuals who do not display athletic abilities or have not had any self-defense training can utilize the system because the system is based on intuitive, uninterrupted and unthinking readiness.

Described below are the details of preferred embodiments of the runner's self-defense system and its components and various features, benefits, and variations, most, as illustrated by accompanying FIGS. 1, 2, 3, 4, 5, and 6.

Figure 2:
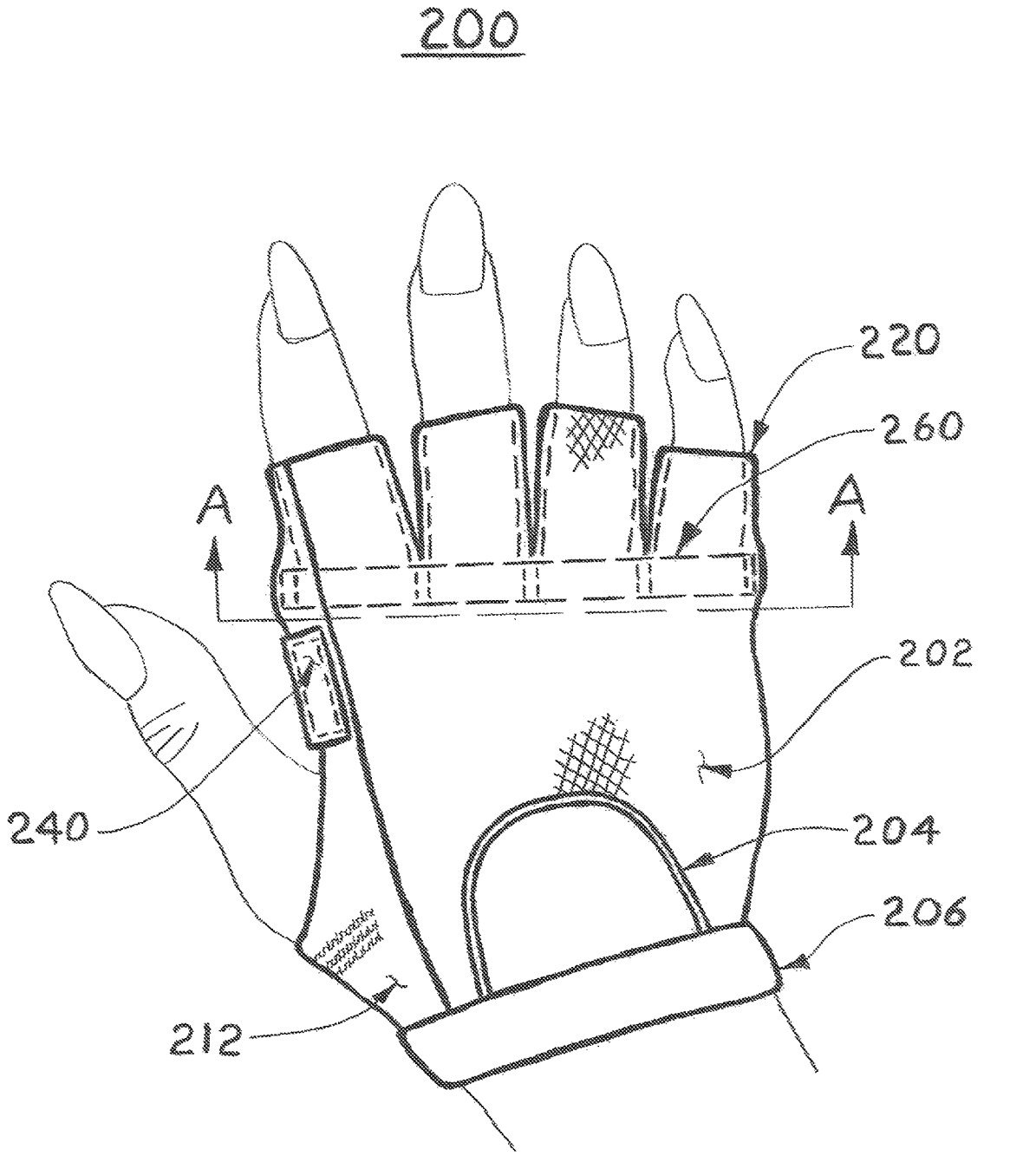
Figure 3:
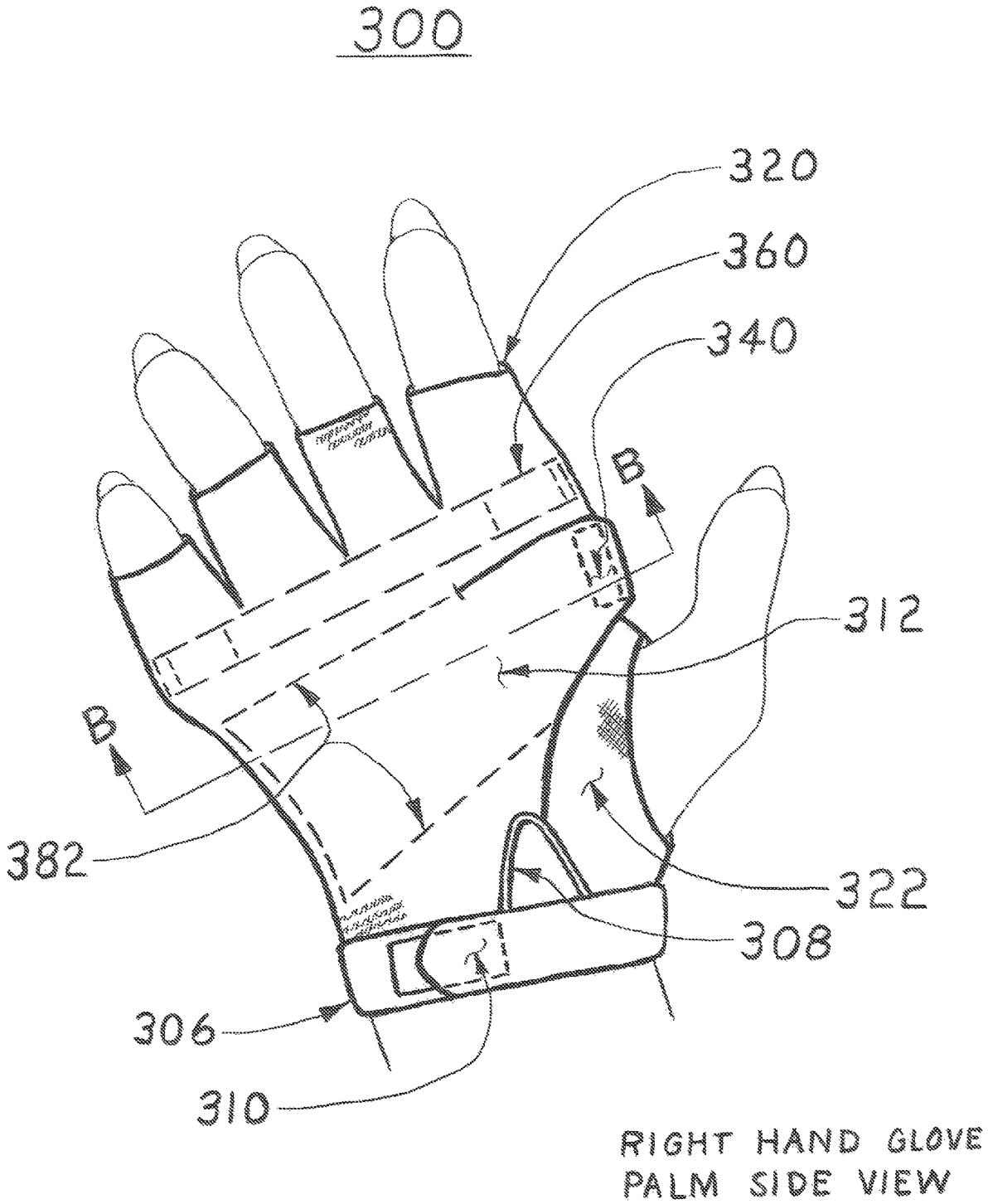
FIG. 3 shows a view of a preferred embodiment of a right-hand glove, palm side of hand view, of the present invention of the Runner's Self Defense System running glove, as worn. Left-hand glove (not shown) is same but opposite of right-hand per FIG. 3. Also shown is the wrist band in closed position.

FIGS. 1, 2, and 3 show views of the gloves finger-tip-less 120, 220, 320 with uncovered thumb providing full range of motion for all fingers digits and thumb, which retain casual hand and finger movements while running, enabling the runner without interruption, to adjust clothing, zippers, buttons, hat, shoes, carry water, phone, or similar. Having the fingers and thumb exposed, the wearer still maintains the ability to grapple, which during an attack, is an instinctive and important element of self-defense. The gloves are at best, if left, finger-tip-less with uncovered thumb.

If weather is harsh and cold, at user's discretion, oversized mittens or similar could be worn over the runner's self-defense system gloves, knowing with certainty, that oversized mittens could be taken off quickly by oneself, or if pulled off during an attack, the wearer would not be disarmed, because the system gloves will remain intact. Hands will always be in the desired optimal ready position, always ready to defend oneself.

FIGS. 1 and 2, show views of the left-hand glove 102 and right-hand glove 202, with backside fabricated from open mesh fibrous material, woven for ventilation, using cotton or polymeric twine or similar, that easily wicks moisture away from the skin, keeping the hands cool while running and also serves as a simple, convenient, safe, and practical perspiration brow wipe. The gloves are easily kept clean by simple hand washing with soap and warm water, rinsed with clean water, and then left out in the open to air dry.

The backside 104, 204, also illustrates another method to keep the hands cool, use of a notched-out portion of material to expose more hand skin surface. FIG. 3. also shows an additional cooling notch 308 on palm side, just above the wrist band.

There are many materials and methods of cooling the hands available that could be considered practical and functional and could serve as useful alternatives to those mentioned. All materials considered could be based on seasonal high and low temperatures to accommodate various running climates and the runner's needs.

Using dark earth tone colors are good choices for keeping the gloves inconspicuous and low profile, not calling attention to the self-defense gloves that incorporate the concealed, combative inner striker plate, 160, 260, 360 depicted in FIGS. 1, 2, and 3, hidden views. The intended use of the running gloves used for self-defense is unknown due to the concealment of the combative striker plate remaining hidden from view. Not bringing attention to the gloves may be desirable tactic to protect the element of surprise during an attack, concealment is the preferred embodiment.

However, it is reasonable that high profile and high visibility of the gloves could be desirable to the user. Bright colors and reflective materials could be used to keep the runner/jogger/walker more visible and safer when faced with road traffic and/or low visibility weather conditions encountered either purposeful or accidental. Some runners may want to alert and expose to possible predators, forewarning them that the runner may be using a self-defense system and they are ready to engage and defend themselves if approached. It is reasonable that this aggressive attitude could perhaps prevent an attack, further expanding the useful capacity of the present invention.

FIG. 3 the right-hand glove view, palm side up, shows the exposed palm outer layer. This outer material layer 312 is firm, rugged yet flexible, and additionally perforated for keeping the hands cool. Materials used could be made from synthetic or natural materials such as suede, leather, or vinyl having same or similar features. There are many materials available that could be considered practical and functional and could serve as useful alternatives to those already mentioned.

The firmness of the palm outer layer material provides stability of the glove position and fit on the hand so that during an attack or any physical confrontation, the glove remains in optimal position, not twisted or turned out of shape. The ever-ready position is not compromised, the glove cannot be easily twisted or pulled off. With hands in the closed fist position, the wearer cannot be disarmed during grappling, blocking, or striking back against a predator.

In the following description, items, having similar numbers in different figures, are similar to each other, and may be represented by a number from a figure and denote the same/similar item when shown in other figures.

Figure 4:
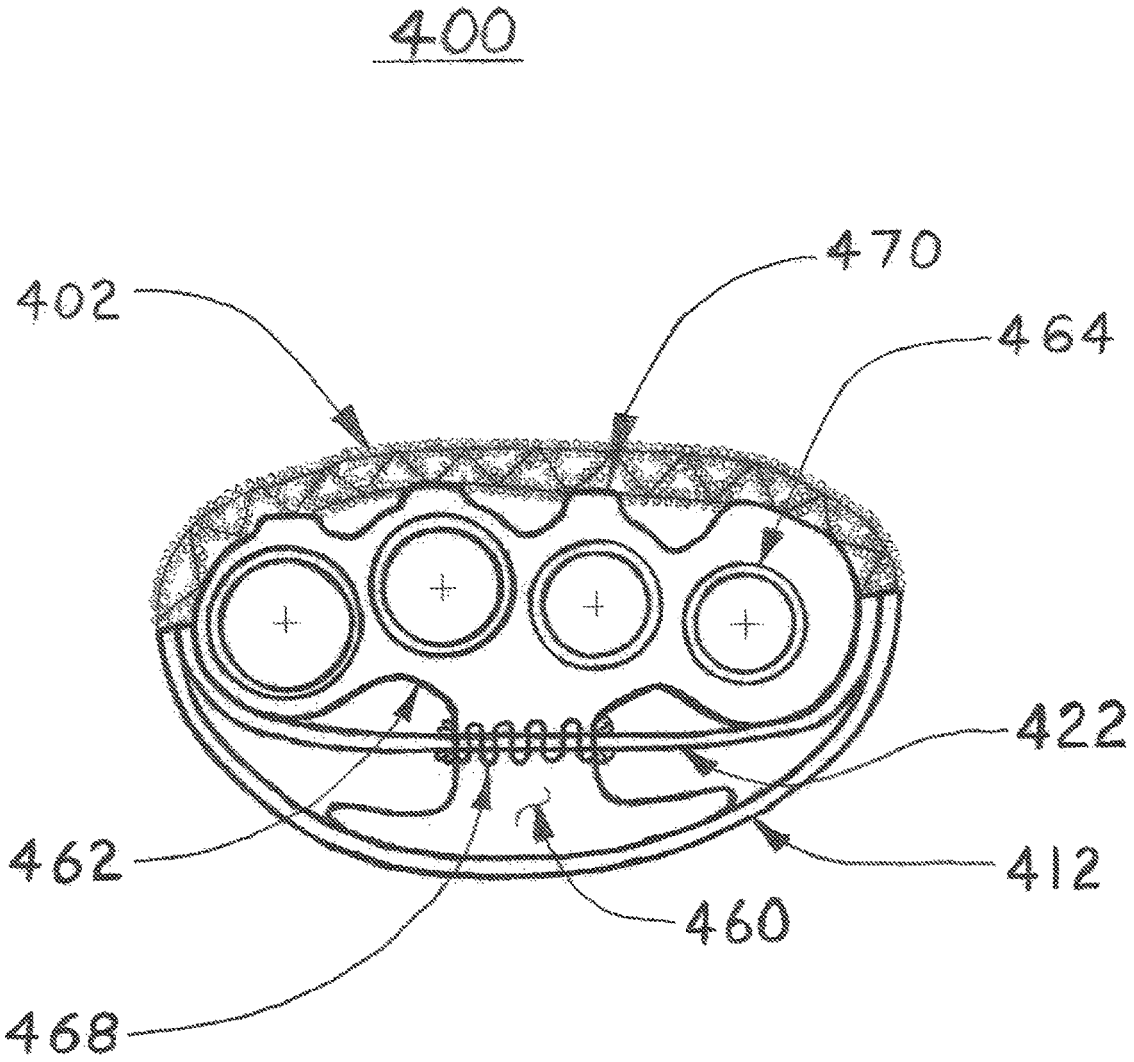
FIG. 4 illustrates a detailed sectional view A-A, palm side down, from FIG. 2 of a preferred embodiment of the concealed striker plate, a combative component, with palm support appendage anchored between palm material layers of the present invention of the Runner's Self Defense System, running gloves.

The firmness of the palm outer layer 112, 212, 312, 412, 512 also functions as one of the two layers of the internal anchoring pocket that secures the striker plate palm appendage 160, 260, 360, 460 in place within the palm and creates the desired tension, gently pulling the fingers into a closed, loose fist position. The internal anchoring pocket consists of one outer layer 312 (FIG. 3) and one inner layer 322. FIG. 4. sectional view shows both layers 412, 422 and the position of the fixed striker plate palm support appendage 460, how it is held, fixed in place, inside the anchoring pocket material layers.

The material ruggedness provides long wear with added protection for the hand(s) in the event of a fall from tripping or similar, when often the hands are outstretched in attempt to break one's fall. The palm material will absorb most of the trauma yet the glove will remain intact and in position. Running gloves that offer both hand protection and self-defense can be a desirable addition to standard running gear.

In FIG. 3, the right hand glove view, palm side up, shows a portion of the internal palm liner 322 along the base of the thumb, made from lightweight wicking material or similar and functions to transfer moisture away from the palm, keeping the hands comfortable while running. A portion of the internal liner also functions as the critical material layer used as the locking anchor point that holds the striker plate palm support appendage in place, fixed within the glove.

FIG. 3 shows the open palm, a Velcro tab 310, a method to open and securely close the glove, located palm side at narrowest part of the wrist. This preferred embodiment does not obstruct any movement of hand or fingers, or rotation of wrist, while serving as a quick, reliable and easy means to securely close the cuff wristband at the wrist comfortably with controlled compression using a self-adjusting Velcro tab or similar. It is the placement and fit of the glove cuff wristband 106, 206, 306 that further aids the overall system making it difficult during an attack to disarm the wearer.

The cuff wrist band 106, 206, 306 could also be made from stretching materials, elastics or similar, whereas the glove cuff wrist band could stretch and self-adjust to the wrist instead of using a Velcro tab system. Using various sewing stitches added to the cuff band is yet another technique that could provide similar results. Unfortunately, using stretch materials and sewing techniques alone that self-adjust may lack the ability to control the compression applied to the wrist. Using the preferred Velcro tab fastening method is least subject to wear and will ensure best fastening fit, security and integrity for the longest period of time.

Figure 5:
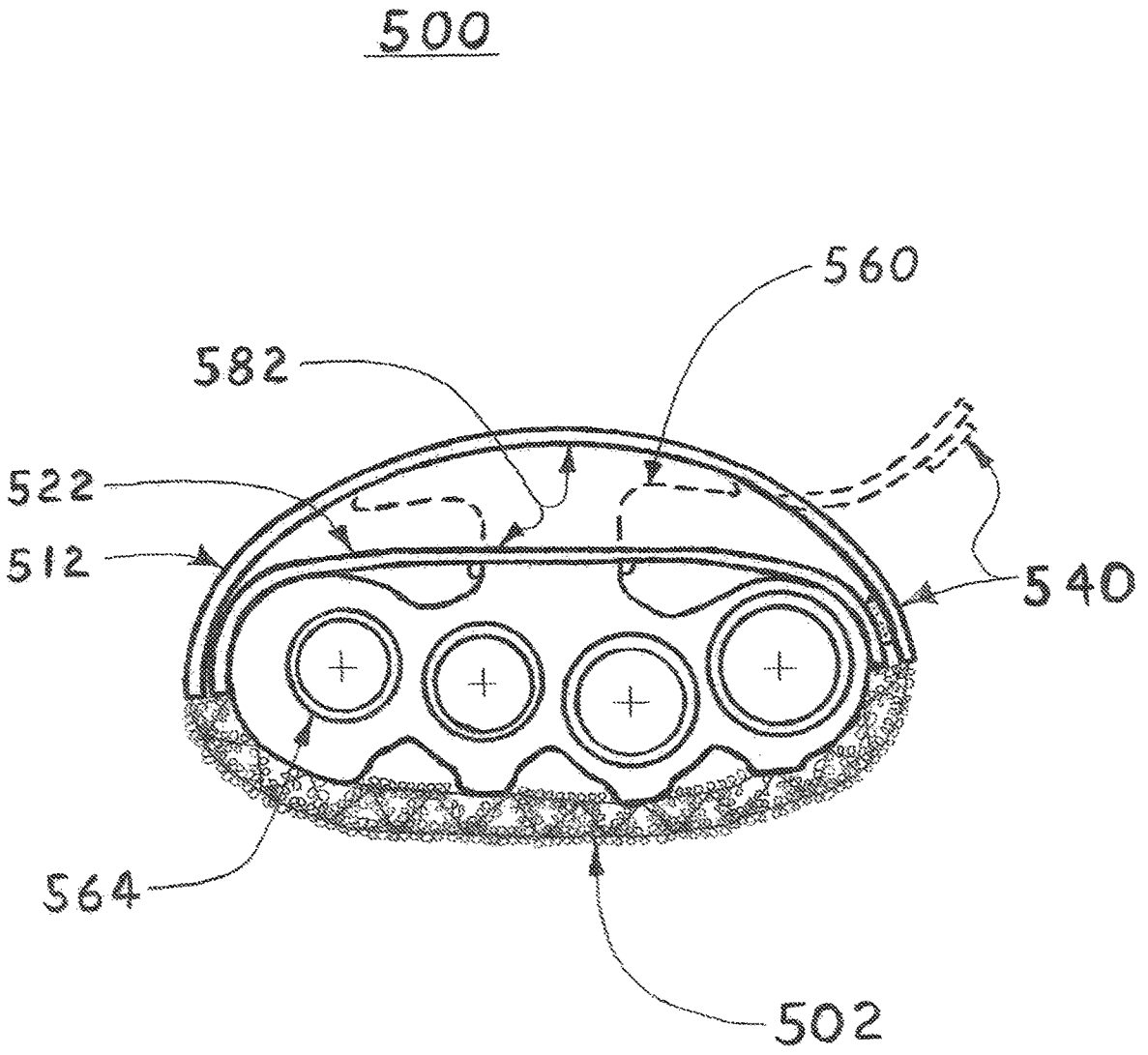
FIG. 5 illustrates detailed sectional view B-B, palm side up, from FIG. 3 of a preferred embodiment of the internal palm pocket with pull tab closure of the present invention of the Runner's Self Defense System running gloves.

FIGS. 3 and 5 show the glove palm pouch 382, 582, being the open space between the layers of the palm internal liner 322, 522 and the palm outer layer 312, 512, situated in the palm area from the wrist band 306 to just below the striker plate appendage 460, 560. This carry pouch is of adequate size to store palm sized personal item(s) at runner's discretion, and is secured with a small Velcro tab 140, 240,340, 540, or similar. FIG. 3, 382 shows the stitch lines outlining the pouch where the inner and outer liners are fastened together. Items to carry could be keys, identification, flat whistles, misc. cards, money, or other items. The palm pouch is a convenient detail but is not necessary for the function of the Runner's Self Defense System. Other similar details could be added or deleted and would still be within the scope of the present invention.

FIGS. 1, 2, and 3 show the striker plate 160, 260, 360 being concealed inside of the glove yet in direct contact with the runner's fingers, the striker plate not being easily detected, thus providing the runner with the advantage of having the element of surprise, supporting the preferred embodiment.

Attempting to wear the striker plate over a glove would compromise, the runner's self-defense system, breaking the chain of, fingers fitted to plate, plate fitted to glove. The striker plate appendage could now be easily grabbed during an attack and pulled off the hand(s) which could result in serious finger joint(s) injury while disarming the runner. Without the striker plate appendage locked in fixed position, correctly positioned between the palm outer and inner layers of the glove, there would be no subtle pull of the fingers into the desired loose closed fist position without using human effort and energy and no longer achieving a state of uninterrupted and unthinking readiness.

FIG. 4 shows sectional view A-A, illustrating the two palm layers, firm outer layer 412 when assembled with the inner layer 422 and how the two layers creates the critical anchor point where the striker plate palm support appendage 460 is sandwiched between the material layers, lock stitched 468 and fixed into position within the glove, between the internal liner 422 and outer layer 412. When wearing the gloves, the position of the palm, support appendage is fixed between these layers between the fingers and palm, cradled in place by the runner's loosely closed fist. The key fixed position of the palm support appendage 460 combined with slight pressure exerted against the appendage by the palm outer layer 412 is what initiates and maintains a, slight, yet subtle pull of the glove, the tension pulling the fingers, drawing, them into the loose, closed fist position ideal for running, without use of any effort or energy, thus, maintaining the state of uninterrupted and unthinking readiness while providing the most natural hand position ideal for both running and self-defense.

FIG. 4 shows the full view of the striker plate 462 being complete with finger holes 464 and the palm support appendage 460. The position of the finger holes 464 assist in keeping the finger digits in a loose fist position for readiness and provides support and stability of the fingers and joints during hand strikes. The loose fist position is the preferred hand position for running, the hand being relaxed, without tension.

Finger holes 464, four holes for four finger digits, are correctly sized and for each finger. The finger hole pattern deliberately raises the first two digits for best striking points while allowing the last two digits to drop into a natural position. Although four finger holes are the preferred embodiment, it may be very useful to offer variations of finger hole FIG. 6 shapes 672, and patterns 674, as special needs may warrant.

The palm support appendage 460, 660, is an important feature of the striker plate as it transfers physical shock from the fingers and joints, directly into the palm and could help prevent the fist from collapse during an attack when striking back in self-defense.

In FIGS. 4 and 5, the outer top profile of the striker plate is shown as an intermittent contour, having raised surfaces 470, 570, above each finger joint to provide protection of finger and knuckle as well as outer sides of the hand. The full contour allows an effective and efficient striking ability from nearly all hand positions as well as providing hand protection. Other variations of the contour (FIG. 6) 678, can be used with same results. It is reasonable to extend these contact surfaces further by machining techniques, inserting, or bonding in place add-on striking points (FIG. 6) 676, which would could easily boost the level of injury one could inflict against a predator.

Figure 6:
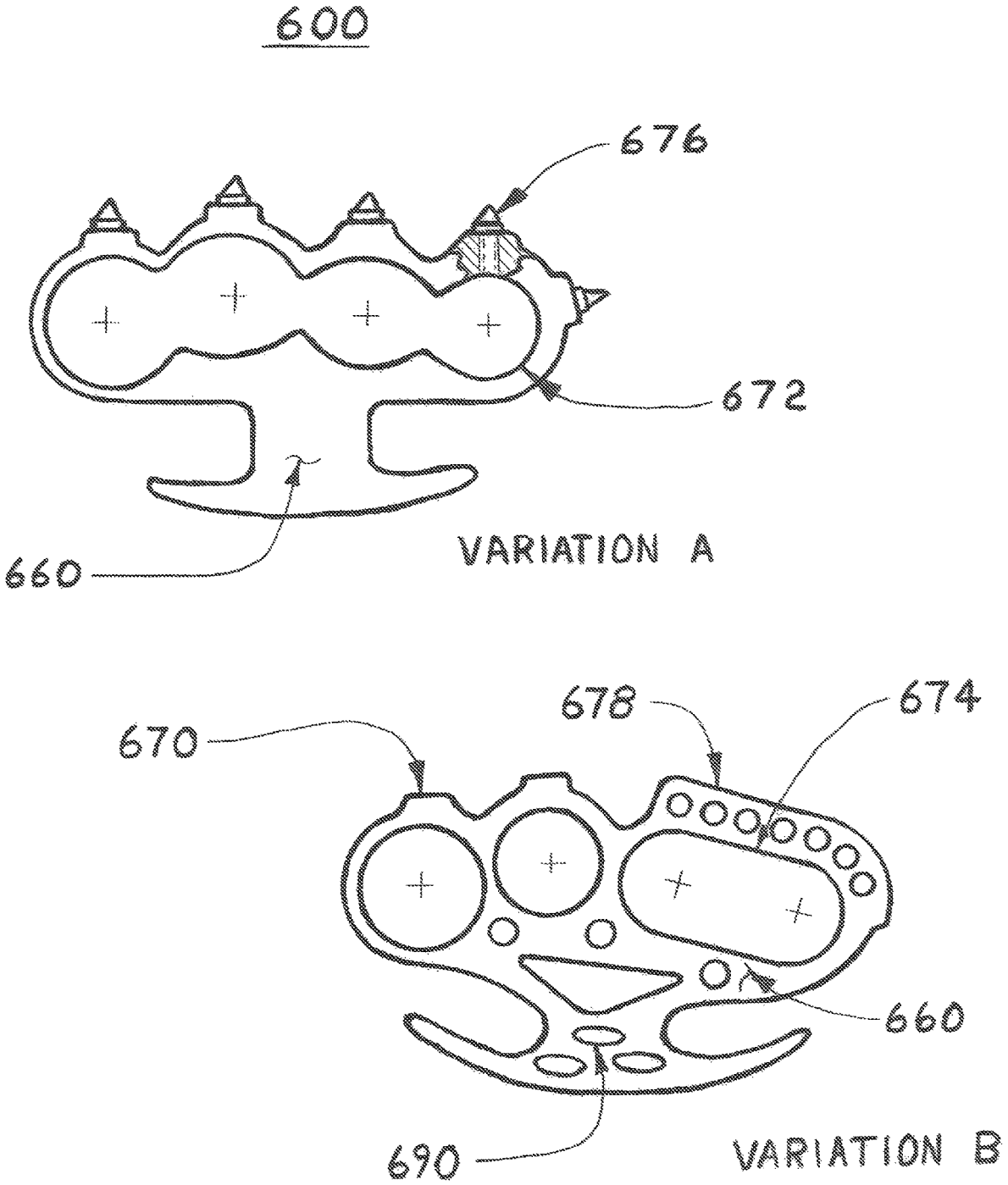
FIG. 6 Variation A shows a view of modified finger holes and inserted striking points while FIG. 6 Variation B shows a view of modified outer contour of striker plate with added thru hole vents, and combined finger holes, another embodiment.

FIG. 6 variation A and B show a variety of alternative finger holes 672, 674, and styles, allowing more or less room for each finger as needed, alternative patterns suited for special fittings. Other finger hole variations/modifications including number, size, shape, positioning, size of chamfer, or others can easily be integrated to accommodate the specific needs of those who would benefit most from a custom fit.

The thickness or width of the striker plate, including appendage, can vary as it is fitted to the finger length from base of finger to first joint in closed position, nesting comfortably at the base of and around each finger digit. Correct thickness of the plate will provide finger protection and will retain full finger digit mobility, and will be comfortable to wear. Adding through-holes (FIG. 6) 690, slots, or perforations to the plate can aid in cooling or to reduce weight.

Although the materials used for the striker plate may vary, it is best to use lightweight, non-corrosive metals or high-density plastics with smooth finishes.

Generally, changing shapes, contours, blends, and other finger hole arrangements including size, location, number of holes, or other related details could be considered adequate as well and are recognized as part of the present invention.

Having described many of the preferred embodiments of the invention with reference to the accompanying drawings, it is to be understood that the invention is not limited to these precise embodiments, and that various modifications, including striker plate design, finger fit variations, striking points, and glove style and materials, and more, may be effective therein by one skilled in the art without departing from the scope or spirit of the invention as defined.

What is claimed is:

1. A runner's self-defense system comprising:

at least one fitted hand glove to inflict a physical trauma, having a back-side surface and a palm-side surface;

a hidden combative component; and, wherein said combative component is anchored within said glove such that a spring action type of a natural, partial closing of the hand occurs during relaxed use or running, providing a quicker ability to engage in a combative defense use;

wherein said combative component is a solid type brass knuckle and is anchored within said glove between an internal strip of material, and an inside surface of said palm-side surface of said glove.

2. The runner's self-defense system, according to claim 1, wherein said combative component is a striker plate fitted to a hand, and wherein further, said striker plate has at least one finger hole to accept one or more fingers, and the at least one finger hole does not accept a thumb.

3. The runner's self-defense system according to claim 2, wherein said finger holes can accept one or two fingers at a time.

4. The runner's self-defense system according to claim 2, wherein said striker plate is anchored by stitched internal layers of said glove.

5. The runner's self-defense system according to claim 1, wherein said glove is finger-tip-less with uncovered thumb for full range of motion and manipulation of said fingers and thumb during use of the self-defense system.

6. The runner's self-defense system according to claim 1, wherein said back-side surface has a mesh portion for ventilation.

7. The runner's self-defense system according to claim 1 which further comprises a sealable pocket along said palm-side surface of said glove, sized to carry a key, ID or cash.

8. The runner's self-defense system according to claim 1, which comprises an over mitten or glove to provide further protection from the environment selected from the group comprising temperature or precipitation.

9. The runner's self-defense system according to claim 1, wherein said at least one fitted hand glove is a pair of fitted hand gloves.

10. The runner's self-defense system, according to claim 9, wherein said combative component is a solid striker plate fitted to a hand, and wherein further, said striker plate has at least one finger hole to accept one or more fingers, and wherein a thumb is not a finger.

11. The runner's self-defense system according to claim 10, wherein said finger holes can accept one or two fingers at a time.

12. The runner's self-defense system according to claim 10, wherein said solid striker plate is anchored by being stitched between internal layers of said glove.

13. The runner's self-defense system according to claim 9, wherein said glove is finger-tip-less to full range of motion and manipulation of said fingers during use of the self-defense system.

14. The runner's self-defense system according to claim 9, wherein said combative component is anchored within said glove between an internal strip of material, and an inside surface of said back-side layer of said glove.

15. The runner's self-defense system according to claim 9, wherein said back-side surface has a mesh portion to provide some comfort to the wearer in warmer environments.

16. The runner's self-defense system according to claim 9, which further comprises a sealable pocket along said palm-side surface of said glove, sized to carry a key, ID or cash.

17. The runner's self-defense system according to claim 9, which comprises an over mitten or glove to provide further protection from the environment selected from the group comprising temperature or precipitation.

* * * * *